US005362033A

United States Patent [19]

Sakurai et al.

[11] Patent Number: 5,362,033

[45] Date of Patent: Nov. 8, 1994

[54] HOT PLATE FOR KEEPING MOLTEN METAL IN A MOLTEN STATE

[75] Inventors: Seiji Sakurai; Junichi Kuchiki; Hideo Tanaka; Syoichi Naruse, all of Yokohama; Shigeru Fukumaru, Atsugi, all of Japan

[73] Assignees: Nichias Corporation, Tokyo; Ariake Ceramic Constructions Co., Ltd., Kanagawa, both of Japan

[21] Appl. No.: 141,100

[22] Filed: Oct. 26, 1993

[51] Int. Cl.[5] ..... H05B 3/62; C22B 7/00

[52] U.S. Cl. ..... 266/275; 266/242; 373/117

[58] Field of Search ..... 373/117–119; 266/242, 275

[56] References Cited

U.S. PATENT DOCUMENTS

| | | | |
|---|---|---|---|
| 2,963,529 | 12/1960 | Schmidt | 373/119 |
| 3,350,493 | 10/1967 | Randall | 373/119 |
| 4,435,819 | 3/1984 | Plume | 373/119 |
| 4,556,202 | 12/1985 | Yamura | 266/242 |
| 5,038,361 | 8/1991 | Wu | 373/119 |

*Primary Examiner*—Peter D. Rosenberg

*Attorney, Agent, or Firm*—Wenderoth, Lind & Ponack

[57] ABSTRACT

A hot plate is used with a molten metal storage container in which a molten metal or bath is temporarily stored prior to any subsequent casting process, and keeps the molten metal temporarily stored in the storage container at a specific constant temperature by heating the molten metal as required. The temperature of the stored molten metal is controlled so that it cannot fall below the particular temperature.

The hot plate includes a heating unit formed in a flat shape from any suitable heat resistant, electrically insulating material and having an electric heating wire or coil therein: and A box unit made of any suitable ceramic material has the flat heating unit freely inserted and removably mounted therein.

As a variation of the hot plate, the box unit may include a ceramic coating layer formed on the outer peripheral surface thereof, the ceramic coating layer being reinforced with any suitable fibrous ceramic textile.

Leads from the electric heating wire or coil may be drawn through the lateral side of the box unit near an upper open side at the top of the box unit.

20 Claims, 5 Drawing Sheets

HOT PLATE FOR KEEPING MOLTEN METAL IN A MOLTEN STATE

BACKGROUND OF THE INVENTION

1. Field of the Invention

The present invention relates to a hot plate for use with a molten metal storage container that stores a molten metal temporarily and which keeps the molten metal temporarily stored in the storage container in its molten state by heating it to a particular constant temperature adequate for a subsequent casting operation, thus preventing the temperature of the molten metal from falling below the specific temperature prior to the casting operation.

2. Description of the Prior Art

In the casting field, metals having a relatively low fusing point, such as aluminum, zinc, copper, and an alloy of any ones of those metals, are temporarily stored in a molten state in a storage container prior to any subsequent casting operation, and any suitable heater is provided in the storage container for keeping those molten metals (which may be referred to as "molten bath", which term will be used in some instances herein and should be understood to have the same meaning as the molten metal) at the particular constant temperature adequate for the subsequent casting operation. The heater is available in various types, such as a radiant heater system, an electric heater system, and the like. There is another heater system that includes a hot plate which is immersed in the molten bath. This hot plate heater system is known to be better than any other prior art heater system, in that it provides the best thermal efficiency, and has no adverse effect on the quality of the molten metal while it is temporarily stored in the storage container.

An example of the heater system of the type including the hot plate that may be immersed in the molten bath is disclosed in a Japanese utility model application now published under No. 2 (1990)-1556. The hot plate includes an electric heating unit which is directly packaged in a ceramics material formed to an appropriate shape. The hot plate may be mounted on the inner wall of a furnace located below the molten bath or may be directly immersed in the molten bath. In the hot plate according to the above application, however, the electric heating unit that includes an electric heating wire or coil, such as nichrome wires, is embedded in electrocasted magnesia shaped as a flat plate compactly packaged in the ceramics material. The hot plate includes materials that have different coefficients of thermal expansion, which may cause great thermal deformation when the hot plate is heated by making the heating coil conduct current, which in turn may cause cracks or breakages in the hot plate. It is possible that any cracks would damage the electrical insulation, leading to a disastrous accident.

SUMMARY OF THE INVENTION

The present invention addresses the problems of the prior art immersion-type hot plate as described above, and proposes to solve those problems.

It is therefore an object of the present invention to provide a hot plate that is capable of keeping a molten metal in its molten state and has the structural and physical strength to resist any possible breakage or damage, such as cracks, that would be caused by any thermal deformation. The hot plate according to the present invention is also easy to use and handle.

In one specific form, the hot plate according to the present invention includes a heating unit formed like a flat plate from any suitable heat resistant, electrically insulating material and having an electric heating wire or coil buried therein, and a box unit made of any suitable ceramics material that provides sufficient internal space to allow the heating unit to be inserted freely and mounted removably or therein interchangeably. The box unit is open at the top, and leads from the electric heating wire or coil of the heating unit are drawn through a lateral side of the box unit located near an upper side open at the top and go out of the box unit.

In another specific form, a variation of the hot plate according to the present invention generally has a similar construction and function as the first specific embodiment, except that the box unit of ceramics has a ceramic coating reinforced with fibrous ceramic textile on its outer peripheral surface.

In the embodiments described above, the box unit of ceramics generally has a shape conforming to that of the heating unit, and is thus formed as a flat, thick plate. It is open along an upper longitudinal side thereof, and may be mounted vertically within the storage container with its open longitudinal side at the top. Within the storage container, the box unit can receive the heating unit through the open side at the top, which unit can be inserted freely thereinto. A variation of the box unit may include a slit of a specific length across the upper longitudinal open sides thereof and extending downwardly therefrom.

The ceramic coating layer reinforced with the fibrous ceramic textile formed on the outer peripheral surface of the box unit may preferably contain one or more ceramic components selected from the group consisting of silicon carbide, silicon nitride, aluminum nitride, boron nitride, and boron carbide. Those ceramic components have the property of not being wetted by the molten bath, and have excellent anti-corrosion properties.

Preferably, fibrous ceramic paper sheets may be interposed in the gaps between the heating unit and the inner wall of the box unit in which the heating unit is mounted.

When the hot plate according to the present invention is actually used, the ceramic box unit is first inserted in its vertical position, with the upper open side at the top, into the molten metal storage container, and is then fixed in position within the container. The position in which the box unit is to be mounted within the container may be selected as desired. The hot plate may serve as a partition or lateral wall separating the space in the molten metal storage container. It has been described that there are the gaps existing between the flat heating unit and the inner wall of the box unit in which the flat heating unit is mounted. As such, any appropriate provision should preferably be made to prevent entry of any molten bath or metal into the gaps. This may be achieved by preventing the upper open side of the box unit and the surrounding area from being soaked by the molten bath or metal.

When electric current is conducted the heating wire or coil buried in the flat heating unit, the heating wire or coil is heated. The heat produced from the heating wire or coil is conducted through the heat resistant, electric insulating material of the flat heating unit, and then the box unit, from which the heat is transmitted to the molten bath which is temporarily stored in the storage container.

As described, the hot plate or its variation according to the present invention, includes the flat heating unit formed to the flat shape from the particular heat resistant, electric insulating material, and has the electric heating wire or coil buried therein, and the flat heating unit may be inserted freely and removably mounted in the box unit, with small gaps left between the flat heating unit and box unit. The heat produced from the heating wire or coil, when current is conducted may cause the flat heating unit to expand thermally or to deform such as by warping. If the heating unit expands thermally or deforms, it may have an effect upon the box unit which may cause it to crack or break. In this event, the small gaps will contribute to canceling or compensating for the above effect. Preferably these gaps have a size ranging between 1 and 3 mm in the direction of the thickness of the heating unit, and ranging between 2 and 5 mm in the direction of the width of the heating unit. If the gaps are smaller than the above values, when the heating unit expands thermally or becomes deformed thermally, this may affect the box unit greatly, causing it to be cracked or damaged. If the gaps are greater, on the other hand, the heat conduction from the heating unit to the box unit may decrease, which may result in a reduction in the thermal efficiency.

In the embodiment in which the ceramic box unit has the coating of ceramic reinforced with the fibrous ceramics textile over the outer peripheral surface thereof, the reinforcing fibrous ceramic textile serves as a core for the ceramic coating layer, which provides increased strength for the box unit. This embodiment can effectively prevent the occurrence of any cracks on the box unit that would otherwise occur. If any cracks should occur, they will not extend to the ceramic coating layer which contain the fibrous ceramics textile as the core. Thus, the ceramic coating layer can block any entry of any molten bath into the box unit. In other words, the box unit can be prevent with the ceramic coating layer, the entry of the molten bath into the box unit through cracks. Therefore, any disastrous accidents can be avoided. The fibrous ceramics textile forming the core may include a a fiber alumina silica textile, fiber carbon textile, and the like.

In the hot plate of the present invention, the flat heating unit may be freely inserted and mounted in the box unit, and may also be removed from the box unit. The flat heating unit is not mounted permanently in the box unit. If the heating wire or coil in the heating unit burns out, it may simply be replaced by a new flat heating unit, and the box unit itself can continue to be used.

The leads from the heating wire or coil may be drawn out of the box unit through the lateral side located near to the upper open side of a box unit. Thus, the hot plate of the present invention may serve as the partition or lateral wall separating the molten metal storage container. This construction permits the use of a top covering or lid which may close the upper open side. The lid may be reopened for internal inspection. It may also remain closed during operation, enhancing the thermal efficiency.

In the alternative preferred embodiment, a slit may be provided across the upper longitudinal open side of the box unit. This slit may have a width of 2 to 3 ram, and the depth of 10 to 50 mm. The slit can compensate for or absorb any additional thermal deformation on the box unit that cannot be compensated for by the small gaps between the heating unit and box unit. Thus, any occurrence of cracks in the box unit can be more effectively prevented. Preferably, the slit should be deep enough to be located above the level of the molten bath in the storage container. In this case, even if the slit should fail to compensate for or absorb any deformation, resulting in the risk of a crack occurring in the box unit, the slit can cause cracks to occur on the portion of the box unit located above the level of the molten bath, and can compensate for the resulting deformation. In this way, no crack can occur on the portion of the box unit located below the level of the molten bath in the storage container, and therefore there is no risk of any molten bath entering the gaps between the box unit and heating unit. Thus, disastrous accidents can be avoided.

Additionally, any suitable fibrous ceramic paper sheet may be interposed as a cushion layer in the gaps between the heating unit and the inner wall of the box unit. This cushion layer can fix the heating unit in its position within the box unit. In the event that any molten bath should enter the gaps at any point, the fibrous ceramic paper sheets will prevent the molten bath from spreading over any other areas of the gaps.

BRIEF DESCRIPTION OF THE DRAWINGS

The above and other objects, advantages, and features of the present invention will become apparent from the detailed description of several particular preferred embodiments that follows hereinafter with reference to the accompanying drawings, in which.

DESCRIPTION OF THE PREFERRED EMBODIMENTS

Figure 1:
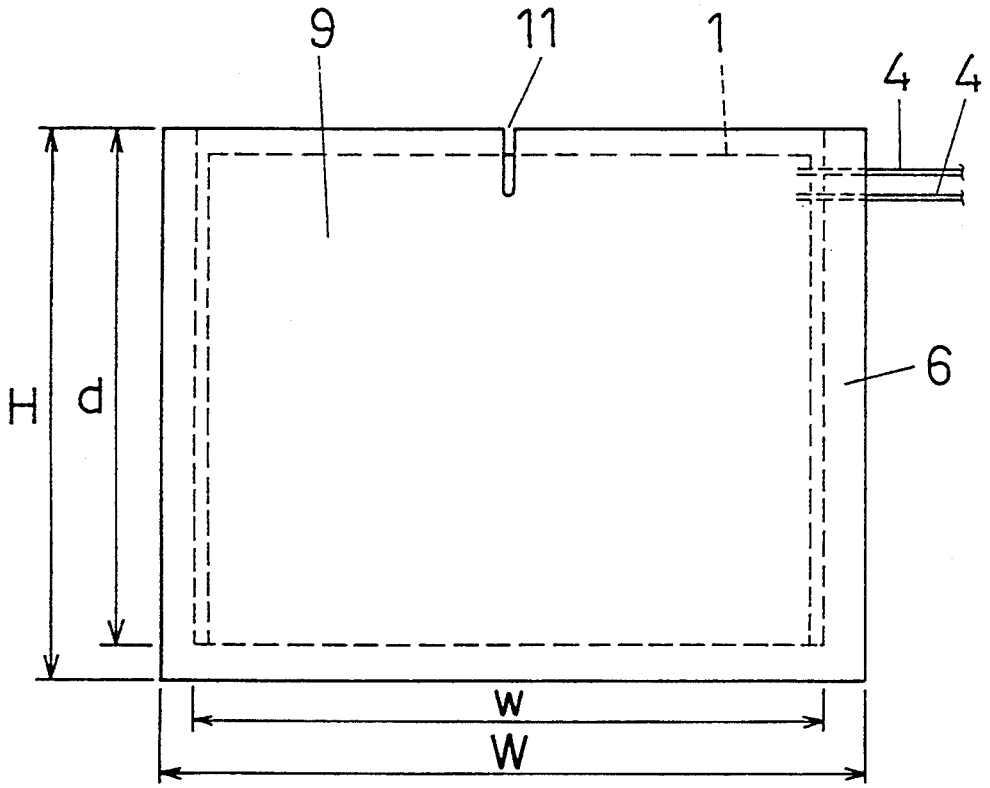
FIG. 1 is a front view illustrating one preferred embodiment of the present invention.
Figure 2:
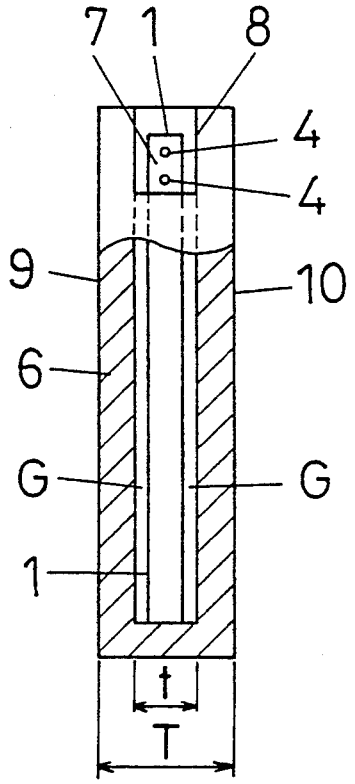
FIG. 2 is a side elevation of FIG. 1.
Figure 3:
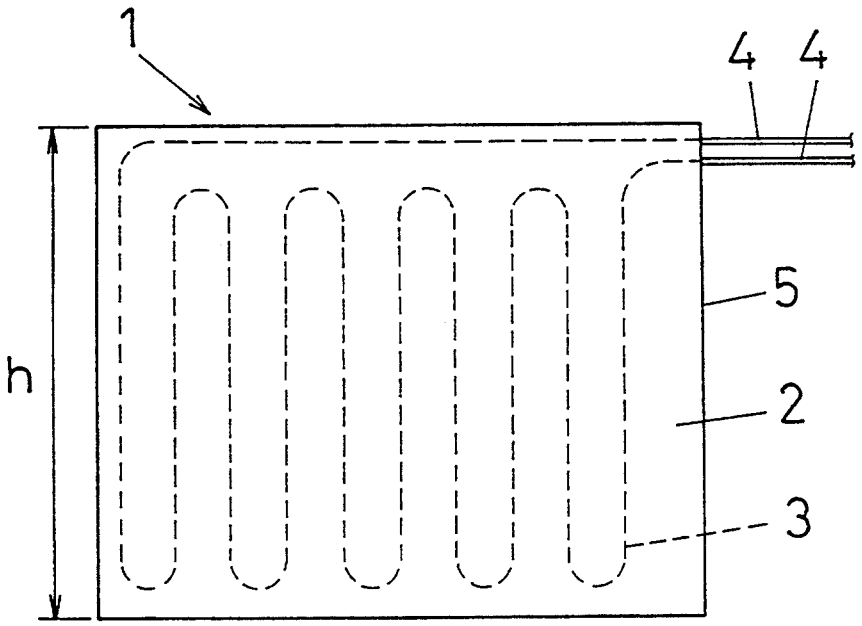
FIG. 3 is a front view illustrating a flat heating unit 1 according to the embodiment in FIG. 1.
Figure 4:
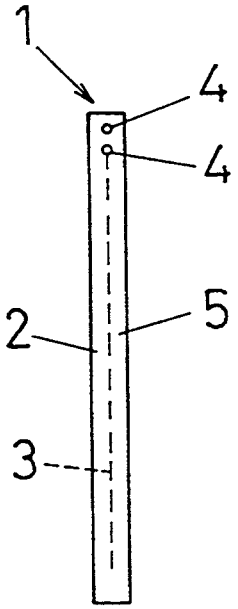
FIG. 4 is a side elevation illustrating the flat heating unit 1 in FIG. 3.

The following description is provided for several preferred embodiments of the present invention shown in the accompanying drawings.

EXAMPLE 1

Referring first to FIGS. 1 through 5, a first preferred embodiment of the present invention is described. In the embodiment shown in FIGS. 1, and 2, a hot plate includes a flat heating unit 1 which is also shown as an independent unit in FIGS. 3 and 4 prior to being mounted. The flat heating unit 1 is formed as a flat shape from any suitable material 2 having good electrical insulation and heat resistance properties, such as a stamped-out high alumina material, and has an electric heating wire or coil 3, such as nichrome wire, buried or embedded therein. The nichrome coil or wire 3 may be buried in the heating unit when it is formed in to the flat shape. Leads 4 from the nichrome coil 3 may be drawn out of the flat heating unit 1 through a lateral side 5 near an upper longitudinal side when it is actually mounted in its vertical position in a box unit.

A box-type unit 6 is formed from any suitable types of ceramics, such as silicon carbide, boron nitride, and the like, known also as castable refractories. It may consist of laminated ceramics sheets joined together.

The box unit 6 provides a spatial area or interior space that is internally large enough to accommodate the flat heating unit 1 therein, the space being defined by interior surfaces of said box unit 6. Specifically, the internal spatial area may have a thickness t across its horizontal section that is by about 1 to 3 mm greater than that of the flat heating unit 1, a width w that is by about 2 to 5 mm greater than that of the flat heating unit 1, and a depth d that is sufficiently greater than the height h of the flat heating unit 1. Thus, the box unit 6 allows for the flat heating unit 1 to be inserted freely into the internal spatial area, with gaps of about 1 to 3 mm left between the two units in the direction of the thickness of the heating unit and with gaps of about 2 to 5 mm left between the two units in the direction of the width of the heating unit.

Figure 5:
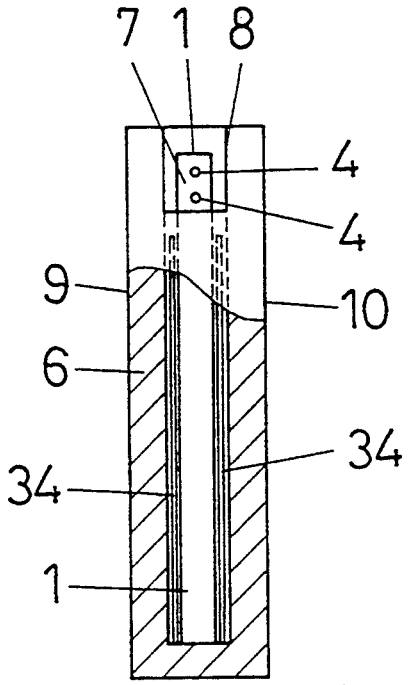
FIG. 5 is a side elevation illustrating a variation of the embodiment shown in FIG. 2.
Figure 6:
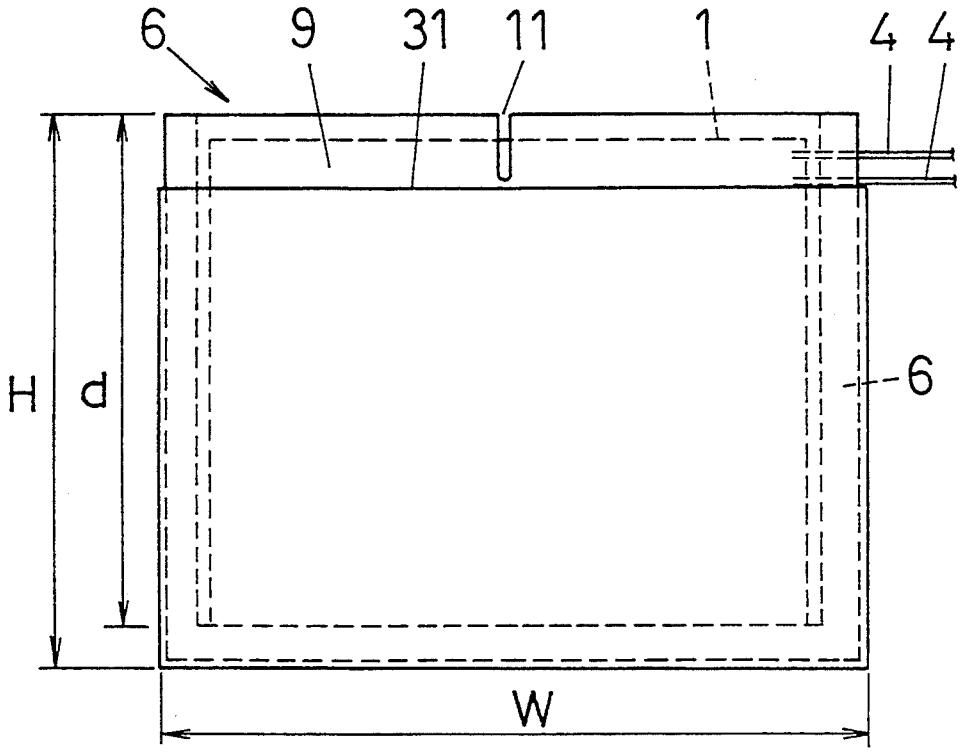
FIG. 6 is a front view illustrating another preferred embodiment of the present invention.
Figure 7:
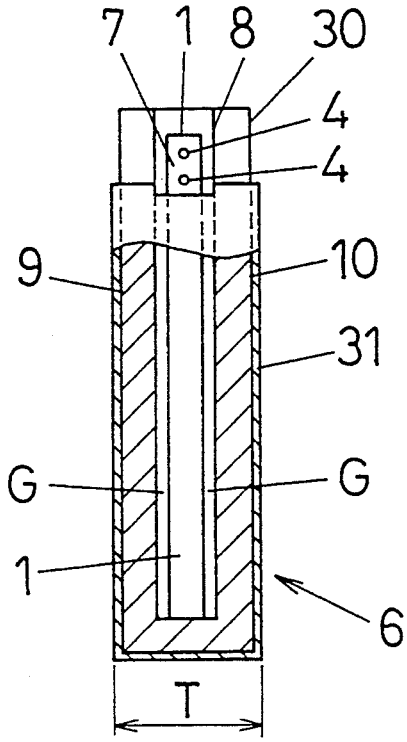
FIG. 7 is a side elevation of FIG. 6.
Figure 8:
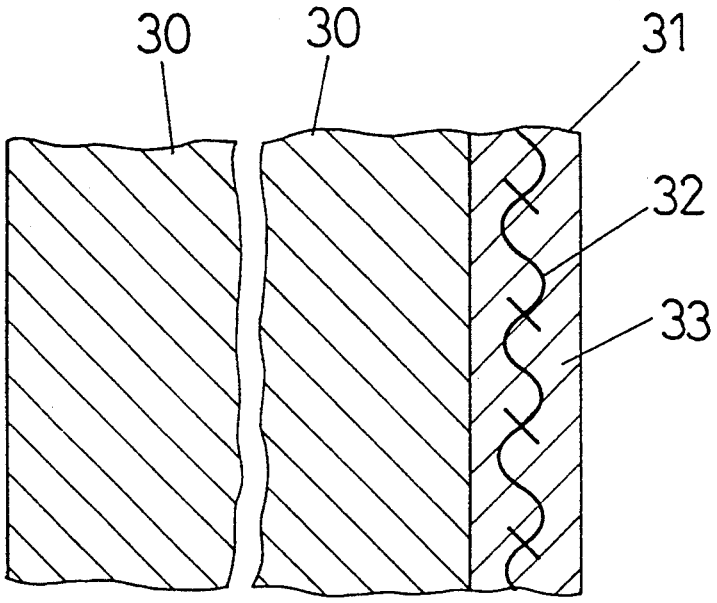
FIG. 8 is a sectional view illustrating a ceramic coating 31 in the embodiment of FIG. 6, shown on an enlarged scale.

Particularly, gaps G, G that extend longitudinaly of the flat heating unit 1 may include a fibrous ceramics paper sheets 34, 34 as a cushion layer, as shown in FIG. 5.

The portion of a lateral side of the box unit 6 that is located opposite a point 7 where the leads 4 from the flat heating unit are drawn has a cutout 8 through which the leads 4 may be guided out of the box unit 6. Additionally, a slit 11 is provided across the upper open longitudinal side, extending downwardly on each of the lateral sides 9 and 10 of the box unit 6 (FIG. 1). Each of the slits 11 has a width of 2 to 3 mm and the depth of 10 to 50 mm. These slits 11 are capable of absorbing any thermal deformation that may occur in the box unit 6.

Preferably, the hot plate completed as described above has the physical dimensions of the height H=449 mm, width W=525 mm, and thickness T=60 mm. Those dimensions which are given above are only an example, and are therefore not specific to the present invention. It should be understood that the dimensions are not limitative, but may be varied depending upon any particular size and form of the molten metal storage container being used with the present invention.

EXAMPLE 2

Another preferred embodiment of the present invention is described by referring to FIGS. 6 through 9.

A hot plate according to the current embodiment has the construction similar to that in the preceding embodiment (EXAMPLE 1), except that it includes a ceramic box unit 30 having a ceramic coating 31 on the major part of the outer peripheral surface thereof (at least the total area of the box unit 30 that is immersed in the molten bath). Therefore, similar parts or elements in FIGS. 6 through 9 are given similar numerals or letters as used in FIGS. 1 through 5.

A flat heating unit 1 included in the current embodiment is the same as that for the preceding embodiment, and is not further described here. Similarly, the ceramic box unit 30 has the same constructional and functional features as described with reference to the box unit 6 and FIGS. 1 and 2 in the preceding embodiment, and is not further described here.

The ceramic coating layer 31 specific to this embodiment may be formed on the particular outer peripheral part of the box unit 30, as follows. A particular coating material is first deposited onto the total outer peripheral area of the box unit 30. Preferably, the coating material may be composed of the following proportions of components as listed below.

(1) 0 to 20 parts by weight of ceramic fibers (short fibers) such as alumina fibers, silica alumina fibers, and the like.

(2) 20 to 60 parts by weight of powdery ceramics, such as silicon carbide, silicon nitride, aluminum nitride, boron nitride, boron carbide, and the like, which are difficult to be wetted by molten metal and have excellent anti-corrosion properties.

(3) 30 to 70 parts by weight of inorganic binders, such as colloidal silica, colloidal alumina, aluminum phosphate, and the like.

Before the coating that has been applied as above becomes dry, a textile woven from ceramic fibers such as alumina fibers, preferably a coarse plain textile, is pressed against the initial coating layer until it is completely attached to the coating layer. A second coating of ceramic is then applied to the extent that the ceramics fiber textile beneath the second coating becomes invisibly hidden behind the second coating. After drying is completed, a further coating of ceramics may be applied as required. The result thus obtained is then heated to a higher temperature, e.g., about 800° C., than the actual temperature to which the hot plate is exposed during its use. Through is heat treatment process, the coating layers are allowed to be hardened. The resulting ceramic layers 31, including a fibrous ceramic textile layer 32 and a hardened coating layer 33, are shown on an enlarged scale in FIG. 8, from which it may be seen that the layers 31 undetachably adhere to the ceramics box unit 30.

Figure 9:
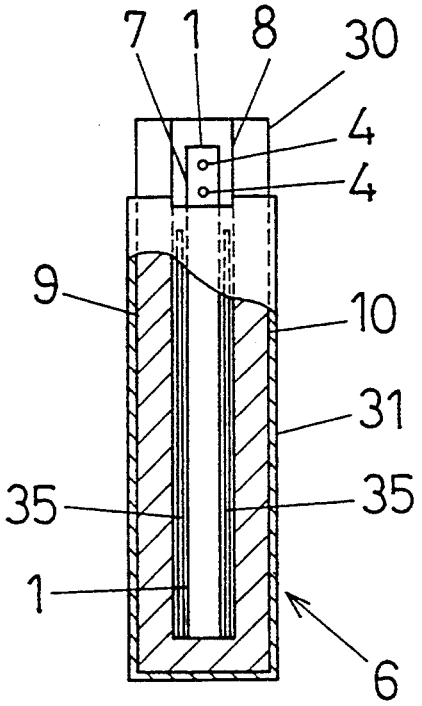
FIG. 9 is a side elevation illustrating a variation of the embodiment shown in FIG. 7.

Similar to the preceding embodiment (EXAMPLE 1), the current embodiment includes fibrous ceramics paper sheets 35, 35 that may be interposed as an additional cushion layer in the gaps G, G between the box unit 6 and the flat heating unit 1 (FIG. 9).

EXAMPLE 3

The use of the hot plate of the invention described in the preceding embodiments in conjuntion with the molten metal storage container is described with reference to FIGS. 10 and 11. Each respective type of the hot plates in the preceding embodiments can be used in the same manner, and the following description applies to both types of the hot plates.

Figure 10:
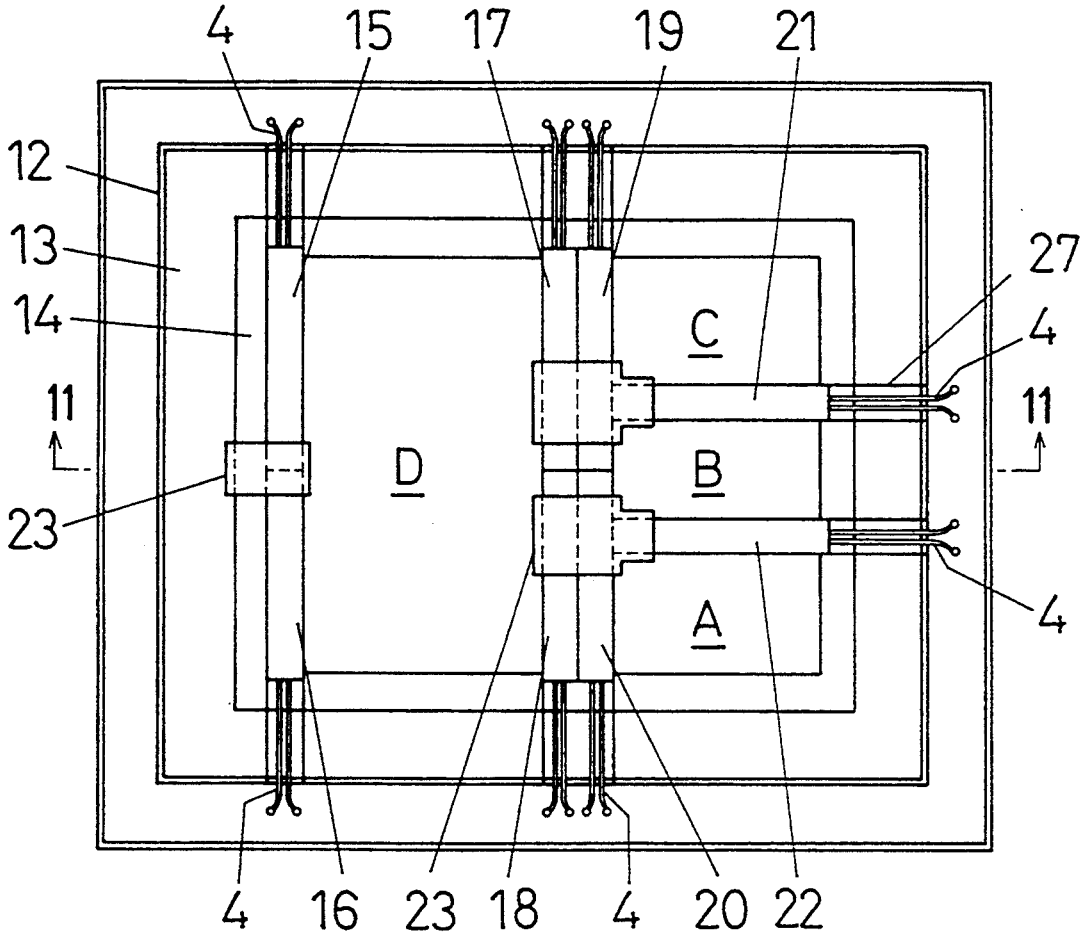
FIG. 10 is a plan view illustrating a molten metal storage container that may be used with a hot plate according to the present invention with a top covering or lid removed.
Figure 11:
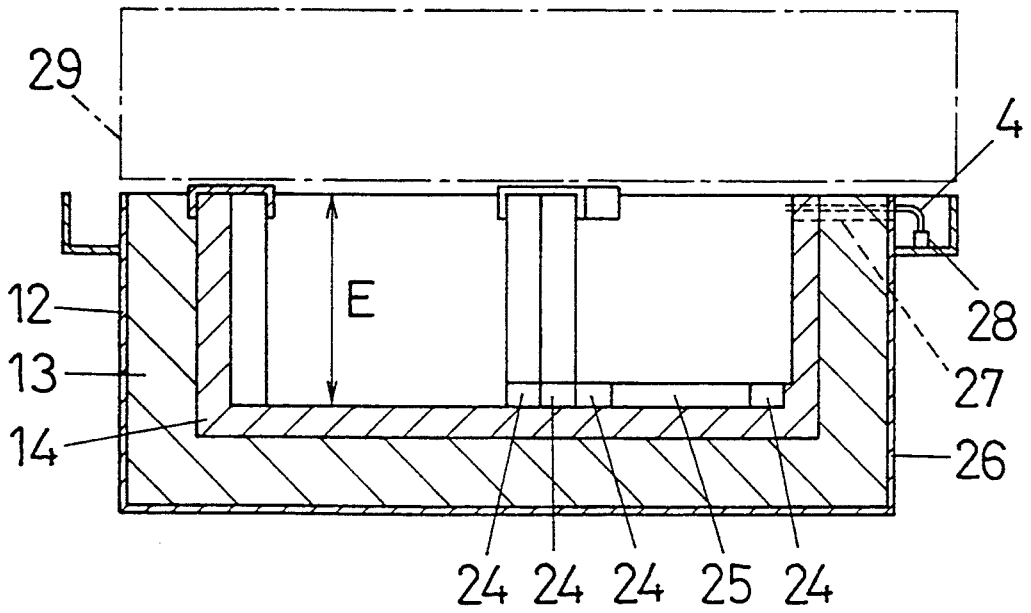
FIG. 11 is a sectional view taken along a line f—f in FIG. 10.

Referring to FIGS. 10 and 11, a molten metal storage container is shown which may be used with the hot plate of the present invention. The container essentially comprises a metal casing 12 that includes an heat insulating material layer 13 and a lining 14 which are attached on the inner wall of the container in that order. Individual hot plates 15, and 16 are mounted and secured along the inner wall, and individual hot plates 17 through 22 are also mounted and secured. The hot plates 17 through 22 act as partitions. Thus, the container is internally divided into four rooms designated by A to D. Each of the hot plates engages corresponding grooves provided on the inner wall of the container, and may be secured to the container by the respective tightening means 23. On the bottom of the container, there is a refractory brick 24 which is placed between the bottom and each respective hot plate 17 through 22 with a spacing relative to the corresponding hot plate. A tunnel 25 delimited by those bricks 24 provides a passage to communicate the four rooms A to D with each other.

The leads 4 from the heating unit 1 are passed through an outlet 27 on the lateral side 26 of the container, and are connected to the terminals 28 on the power distribution board.

The depth E of the container corresponds to the height H of each hot plate (or equal to the sum of the heights of the hot plate and brick 24). Thus, when a top covering or lid 29 is closed, it can engage the top of the lateral side 26 of the container as well as the top of each individual hot plate.

A molten metal or bath first enters the room A, for example, and flows through the tunnel passage 29, entering the remaining rooms sequentially until it finally fills all rooms. The molten bath exits from the room C, for example. The level of the molten bath in the container is kept below the lower end of the slit 11. As long as it stays in the container, the molten bath is kept at a specific constant temperature under the heat produced from the energized nichrome wire or coil 3 buried in each of the heating units 19 to 22. The temperature of the molten bath in each room is monitored, and is controlled by turning the appropriate nichrome wire 3 on or off so that the molten bath in the final room, e.g., C, can be kept at the specific temperature from which it can be delivered at that temperature. As is the case with the prior art hot plate, the hot plate according to the present invention can prevent the temperature of the molten metal temporarily stored in the container from falling below the particular temperature. For example, for the molten aluminum that is temporarily stored in the container, it can be kept at a temperature of not less than 680° C.

Although the present invention has been described fully with reference to the particular preferred embodiments thereof, it should be understood that various changes and modifications may be made without departing from the spirit and scope of the invention as defined in the appended claims.

What is claimed is:

1. An apparatus, comprising:

a heating unit comprising a heat resistant and electrically insulating material having an electric heating wire embedded therein; and a box unit comprised of a ceramic material, said box unit having interior surfaces defining an interior space, an upper side open to said interior space, and a plurality of lateral sides, one said lateral side having an outlet from said interior space located adjacent to said upper side, said heating unit being removably disposed in said interior space of said box unit;

wherein said heating unit has leads extending from said electric heating wire to the exterior of said box unit through said outlet, and wherein gaps are provided between said heating unit and said interior surfaces of said box unit.

2. The apparatus of claim 1, wherein at least one of said lateral sides has a slit therein extending downwardly a specific length from said upper side open to said interior space.

3. The apparatus of claim 2, wherein fibrous ceramic paper sheets are disposed in said gaps between said heating unit and said interior surfaces of said box unit.

4. The apparatus of claim 1, wherein fibrous ceramic paper sheets are disposed in said gaps between said heating unit and said interior surfaces of said box unit.

5. The apparatus of claim 1, and further comprising a molten metal storage container, and said box unit being disposed in said molten metal storage container for maintaining molten metal in said molten metal storage container at a specific constant temperature.

6. The apparatus of claim 1, and further comprising a ceramic coating layer on an outer peripheral surface of said box unit, said ceramic coating layer comprising a fibrous ceramic textile reinforcement.

7. The apparatus of claim 6, wherein said ceramic coating layer further comprises at least one material selected from the group consisting of silicon carbide, silicon nitride, aluminum nitride, boron nitride and boron carbide.

8. The apparatus of claim 7, wherein at least one of said lateral sides has a slit therein extending downwardly a specific length from said upper side open to said interior space.

9. The apparatus of claim 8, wherein fibrous ceramic paper sheets are disposed in said gaps between said heating unit and said interior surfaces of said box unit.

10. The apparatus of claim 7, wherein fibrous ceramic paper sheets are disposed in said gaps between said heating unit and said interior surfaces of said box unit.

11. The apparatus of claim 6, wherein at least one of said lateral sides has a slit therein extending downwardly a specific length from said upper side open to said interior space.

12. The apparatus of claim 11, wherein fibrous ceramic paper sheets are disposed in said gaps between said heating unit and said interior surfaces of said box unit.

13. The apparatus of claim 6, wherein fibrous ceramic paper sheets are disposed in said gaps between said heating unit and said interior surfaces of said box unit.

14. An apparatus, comprising:

a box unit comprised of a ceramic material, said box unit comprising a plurality of lateral sides and a bottom side having external surfaces and internal surfaces, said internal surfaces defining an interior space, and an upper open side open to said interior space;

a heating unit comprising a heat resistant and electrically insulating material having an electric heating wire embedded therein, said heating unit being disposed in said interior space of said box unit such that there are gaps between said heating unit and said internal surfaces of said lateral sides of said box unit, and said heating unit having leads connected to said electric heating wire and extending out of said box unit.

15. The apparatus of claim 14, wherein said box unit has a thickness direction and a width direction, and wherein said gaps in said thickness direction are 1 to 3 mm and said gaps in said width direction are 2 to 5 mm.

16. The apparatus of claim 14, wherein at least one of said lateral sides has a slit therein extending downwardly a specific length from said upper side open to said interior space.

17. The apparatus of claim 14, wherein fibrous ceramic paper sheets are disposed in said gaps between said heating unit and said interior surfaces of said box unit.

18. The apparatus of claim 14, and further comprising a ceramic coating layer on an outer peripheral surface of said box unit, said ceramic coating layer comprising a fibrous ceramic textile reinforcement.

19. The apparatus of claim 14, wherein said ceramic coating layer further comprises at least one material selected from the group consisting of silicon carbide, silicon nitride, aluminum nitride, boron nitride and boron carbide.

20. The apparatus of claim 14, wherein one of said lateral sides has an outlet from said interior space located adjacent to said upper side, and said leads extend from said electric heating wire to the exterior of said box unit through said outlet.

* * * * *